United States Patent [19]

Newman et al.

[11] Patent Number: 4,795,360

[45] Date of Patent: Jan. 3, 1989

[54] ELECTRICAL CABLE CONNECTOR FOR USE IN A NUCLEAR ENVIRONMENT

[75] Inventors: Albert P. Newman; David C. Kamp, both of Cincinnati, Ohio

[73] Assignee: Empire Products, Inc., Cincinnati, Ohio

[21] Appl. No.: 740,192

[22] Filed: May 31, 1985

[51] Int. Cl.[4] ..... H01R 13/52

[52] U.S. Cl. ..... 439/278; 439/277; 439/279

[58] Field of Search ..... 339/60 R, 60 C, 60 M, 339/90 R, 94 R, 94 M, 94 C; 439/271, 275–279, 282, 320

[56] References Cited

U.S. PATENT DOCUMENTS

| | | | |
|---|---|---|---|
| 2,961,630 | 11/1960 | Duncan | 339/90 R |
| 3,477,061 | 11/1969 | Stephenson | 339/90 R |
| 3,775,730 | 11/1973 | Rowls et al. | 339/60 G |
| 3,848,950 | 11/1974 | McCormick et al. | 339/90 R |
| 4,588,247 | 5/1986 | Grappe et al. | 339/94 M |

*Primary Examiner*—Gil Weidenfeld

*Assistant Examiner*—Paula A. Austin

*Attorney, Agent, or Firm*—Frost & Jacobs

[57] ABSTRACT

Mateable receptacle and plug assemblies comprising a cable connector for use in a nuclear environment. The receptacle assembly and the plug assembly comprise mateable metallic shells, each surrounding one or more cable ends terminating in contacts. The contacts of the receptacle assembly and the plug assembly are equal in number and mateable. In each of the receptacle assembly and the plug assembly, the space between the shell and the cable ends and their contacts is filled with one or more heat, steam and radiation resistant insulative elastomeric compounds and/or epoxy compounds to prevent hosing of steam and moisture through the cables. The inside surfaces of the shells are uniquely configured to enhance bonding thereof to the insulative compounds, providing baffles creating pressure drops should the bond fail. O-rings are mounted on the plug assembly shell which cooperate with the receptacle assembly shell to form compression and butt seals to prevent leakage through the shell faces.

19 Claims, 3 Drawing Sheets

ELECTRICAL CABLE CONNECTOR FOR USE IN A NUCLEAR ENVIRONMENT

TECHNICAL FIELD

The invention is directed to electrical cable connectors, and more particularly to such connectors for use in a nuclear environment.

BACKGROUND ART

The present invention is directed to electrical connectors of the industrial type, as opposed to typical household electrical connectors. In their most usual form, industrial connectors are provided in the form of a cooperating male and female pair. The male connector comprises a male contact mounted within an insulative housing. The rearward end of the male contact is provided with means by which it may be connected to a cable or a bus bar. The female connector comprises a female contact mounted in an insulative housing. The female contact is provided with a rearward end with means by which it may be connected to a cable or bus bar. When the cooperating pair of connectors is in its mated or connected condition, the male contact is received within the female contact and a portion of the insulative housing of one of the connectors is received within a portion of the insulative housing of the other, so that the male and female contacts are totally enclosed. Frequently such industrial connectors are provided with means to retain or lock them in their mated or connected condition. In many instances, the insulative housings of industrial connectors are made entirely of elastomeric compounds or epoxy materials. In other instances, they comprise metallic members filled with insulative elastomeric material or epoxy material.

The use of industrial cable connectors in nuclear environments, such as are encountered in nuclear generating station,, has heretofore been largely avoided even though they would constitute a great convenience from the standpoint of replacement and repair of various types of electrical equipment. This is true for a number of reasons. Under normal conditions, electrical connectors in such an environment can be subjected to high doses of radiation, considerable heat and moisture. In the event of a LOCA (loss of coolant accident), the connectors would be subjected to additional radiation, temperatures as high as 350° F., as well as moisture, some in the form of steam. The moisture frequently would contain such materials as sodium nitrate or boron, rendering it even more corrosive.

Over long periods of time, ordinary elastomers tend to continue to cross link, ultimately destroying themselves, becoming hard and brittle. Under conditions of radiation and/or elevated temperatures, ordinary elastomers may have the oils contained therein removed therefrom, resulting in deterioration. Many types of epoxy will tend to shrink or deteriorate due to elevated temperatures and radiation. In connectors containing exterior metallic shells, deterioration of the elastomeric insulative material or shrinking of the epoxy insulative material will destroy the bond between the insulative material and the surrounding metal members as well as the contacts. This bond can be additionally destroyed by oxidation of the metal members. This, in turn, can result in "hosing" of steam and moisture through the connectors and the cables to the electrical equipment to which they are attached, resulting in shut down of such key equipment as fans, pumps and the like, which must be kept running. Therefore, to obviate these problems, most installations in nuclear power plants and the like have been "hard wired", avoiding the use of electrical connectors.

The present invention is directed to industrial electrical cable connectors suitable for use in nuclear environments such as are encountered in nuclear generating plants and the like, and which will function properly even under conditions of a LOCA. The present invention contemplates an electrical connector comprising a male receptacle assembly and a female plug assembly wherein the mateable male and female electrical contacts are surrounded by special elastomeric and/or epoxy compounds resistant to heat, steam and radiation, and capable of maintaining steam and moisture proof integrity to prevent hosing through the cables. The male receptacle assembly and the female plug assembly are provided with metallic shells having uniquely configured interior surfaces to improve bonding between the metal surfaces and the elastomeric or epoxy compounds, and which provide baffles, creating pressure drops if the bond should fail. The same is true of the exterior surfaces of the male and female contacts. This maintains the integrity of the seals for a longer duration. The metallic parts are made of stainless steel or brass. When brass is used, the parts are plated with nickel, chrome or the like to prevent oxidation thereof. The metallic members, when plated, are etched to enhance the bond and prolong the bond life between the metal members and the elastomeric or epoxy compounds. In addition, O-ring seals are provided on the shells to prevent leakage through the faces of the connectors, certain of the O-rings in compression, an at least one O-ring forming a butt seal. The receptacle assembly and the plug assembly may be provided with polarizing keys and keyways to assure proper positioning of the male and female contacts and to enable the male receptacle assembly to be disconnected from the female plug assembly through the use of a pipe wrench or the like, even after years in a corrosive atmosphere. Finally, as will be described hereinafter, two or more special insulating elastomeric or epoxy materials may be used in each of the receptacle assembly and plug assembly, the materials being chosen for their particular properties.

DISCLOSURE OF THE INVENTION

According to the invention there is provided a cable connector for use in a nuclear environment. The cable connector comprises mateable receptacle and plug assemblies. These assemblies constitute mateable metallic shells, each surrounding one or more cable ends which terminate in contacts. The contacts of the receptacle assembly and the plug assembly are equal in number and mateable. In each of the receptacle and plug assemblies, the space between the shell and the cable ends and their contacts is filled with one or more heat, steam and radiation resistant insulative elastomeric compounds and/or epoxy compounds. The inside surfaces of the shells and the exterior surfaces of the contacts are provided with integral annular ribs which enhance the bond between them and the insulative compounds to prevent hosing of steam and moisture through the cables. The annular ribs serve as baffles creating pressure drops, should the bonds fail.

The plug assembly shell is provided with O-rings which cooperate with the receptacle assembly shell to form compression and butt seals to prevent leakage through the shell faces. Two or more of the elastomeric and epoxy insulative compounds may be used in each shell, the compounds being chosen for their particular properties. Finally, the receptacle and plug assembly shells may be provided with polarizing keys and keyways, respectively, to assure that the mateable contacts therein are properly positioned and to enable the receptacle and plug assemblies to withstand wrenching during uncoupling thereof, even after years in a corrosive environment.

DETAILED DESCRIPTION OF THE INVENTION

Figure 1:
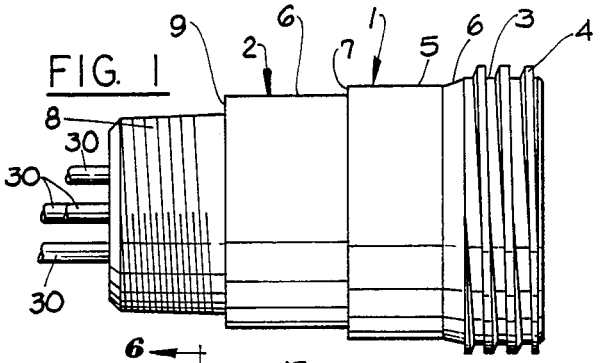
FIG. 1 is an elevational view of the male receptacle assembly of the present invention.
Figure 2:
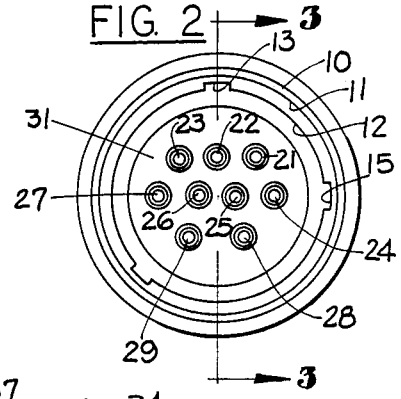
FIG. 2 is a front end elevation of the male receptacle assembly of FIG. 1, as seen from the right of that figure.
Figure 3:
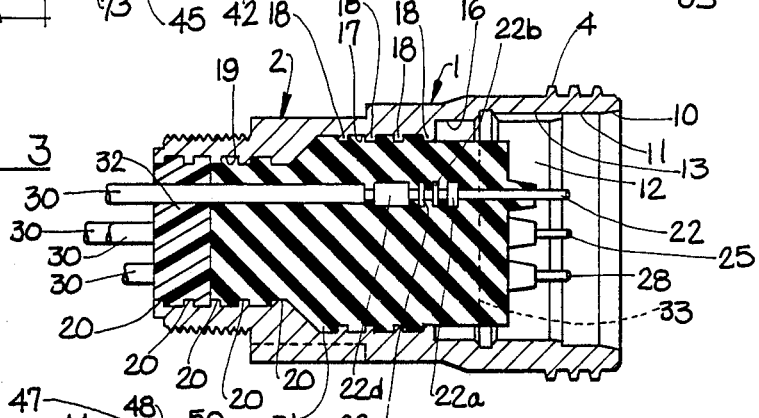
FIG. 3 is a cross sectional view taken along section line 3—3 of FIG. 2.

Reference is first made to FIGS. 1, 2 and 3 wherein the male receptacle assembly is illustrated. In these figures, like parts have been given like index numerals.

The male receptacle assembly is generally indicated at 1 and is provided with a metal shell, generally indicated at 2. The shell 2 is an integral, one-piece, hollow, cylindrical member. Exteriorly, the shell 2 has a forward portion 3 of constant diameter. Near the front end of shell 2, the forward portion 3 is provided with external threads 4. The forward portion 3 is followed by a first intermediate portion 5 of constant diameter, slightly less than the diameter of the forward portion 3. A sloped shoulder 6 is formed between the two.

The first intermediate portion 5 is followed by a second intermediate portion 6 of constant diameter, slightly less than the diameter of the first intermediate portion 5 with a shoulder 7 formed therebetween. The shell 2 terminates in a rearward portion 8 which tapers slightly and is of lesser diameter than the second intermediate portion 6, with a shoulder 9 formed therebetween. The rearward portion 8 is provided with external threads, by which the male receptacle may be affixed to a limit switch, a panel board, or other appropriate mounting member (not shown).

Reference is now specifically made to FIG. 3. Interiorly, the forwardmost end of metallic shell 2 is chamfered as at 10 to more easily guide the forwardmost end of the female plug assembly during the mating or connecting procedure. The chamfer 10 is followed by a surface 11 of constant internal diameter. The surface 11 has formed thereon an inwardly extending rim 12 of substantial width. The rim 12 has formed in it a series of three keyways 13 through 15 (see FIG. 2), unevenly spaced about its circumference. The purpose of keyways 13 through 15 will be apparent hereinafter. The rim 12 is followed by a surface 16 having an internal diameter slightly less than that of rim 12. The surface 16 is followed by a surface 17 of lesser diameter. The surface 17 has a plurality of inwardly extending annular ribs 18, substantially evenly spaced along its face. The surface 17 is followed by a surface 19 of lesser diameter than the surface 17. The portion 19 also has a plurality of inwardly extending annular ribs 20 formed thereon. The purpose of the internal annular ribs 18 and 20 will be described hereinafter.

The shell 2 is preferably made of stainless steel or brass. Where brass is used, it is preferably nickel plated or chrome plated. This prevents oxidation of the base metal. Such oxidation would interfere with the formation of a good bond between the shell and the insulative material to be described hereinafter. Where plating is used, the plated surface is etched to enhance the bond between it and the insulative material.

The shell 1 is adapted to surround and contain one or more cable terminations provided with male connectors. While not intended to be so limited, for purposes of an exemplary showing the male receptacle assembly is illustrated in FIG. 2 as having nine male connectors, each affixed to a cable termination. Some of the cables are visible in FIGS. 1 and 3 at 30.

Male connector 22 is shown in its entirety in FIG. 3. Connector 22 is provided with a plurality of enlarged diameter portions 22*a*, 22*b* and 22*c* to strengthen and enhance the bond between male connector 22 and the surrounding insulative material to be described hereinafter. Connector 22 is also provided with an enlarged socket portion 22*d*, adapted to receive end of cable 30 from which the insulation has been stripped.

The cables 30 and their connectors 21 through 29 are surrounded by an insulative material which not only maintains them in their proper position within shell 2, but also insulates them, one from the other, and from the shell 2.

Appropriate insulative materials, resistant to heat, steam, moisture and radiation are commercially available. For example, there are epoxy compounds suitable for this purpose. Such epoxy compounds utilize an aromatic-type curing agent. An example of such an epoxy compound is manufactured by Emerson & Cuming of Canton, Mass., under the trademark STYCAST and designation 2850FT. There are also synthetic rubbers which are resistant to heat, steam, moisture and radiation. An example of such a synthetic rubber is ethylene, propylene, der-polymer (EPDM) manufactured by E. I. Du Pont Demours & Co. of Wilmington, Del. under the trademark NORDEL and the designation 2522. Another example of radiation, heat, moisture and steam resistant synthetic rubber is chlorosulfonated polyethylene, manufactured by E. I. Du Pont Demours & Co. of Wilmington, Del. under the trademark HYPALON and designation 40.

Two bodies of insulative material are shown in FIG. 3 at 31 and 32. An epoxy compound of the type described above can be used for body 31 although care must be taken in pouring the epoxy compound that air bubbles are not trapped therein. When an epoxy compound is used as the insulative material 31, it is preferred that the rearwardmost part of the insulative material, body 32, be formed of EPDM or chlorosulfonated polyethylene. The same is true of the forwardmost portion of the insulative body 31, as indicated by broken line 33. It is preferred that the end portions of insulative material be somewhat resilient to accommodate for lateral displacement of the free ends of the male contacts and lateral displacement of the cables 30. The forwardmost portion of the insulative materials surrounding the male contacts is formed into small truncated cone-like shapes about the contacts. This is clearly shown in FIGS. 2 and 3. In a preferred embodiment of the male receptacle assembly, the entire insulative body within shell 2 is formed as a single, integral, one-piece body of EPDM or chlorosulfonated polyethylene.

The inwardly extending ribs 18 and 20 of shell 2 improve the band between the insulative material 31 and the inside surface of shell 2. The enlarged diameter portions 22*a*, 22*b*, 22*c* and 22*d* of contact 22 similarly improve the band between the contact 22 and the insulative material. In the event of a band failure, the inwardly extending annular ribs 18 and 20 serve as baffles which create pressure drops, thus maintaining the integrity of the seal between the insulative material 31 and the metallic shell 2 for a longer period of time. The same is true of the interaction between the insulative material 31 and the contact elements 22*a* through 22*d*, precluding, or at least minmizing, hosing of steam through the cable in the event that the bond between the cable 30 and its connector 32 and the insulative material 31 should fail.

Figure 5:
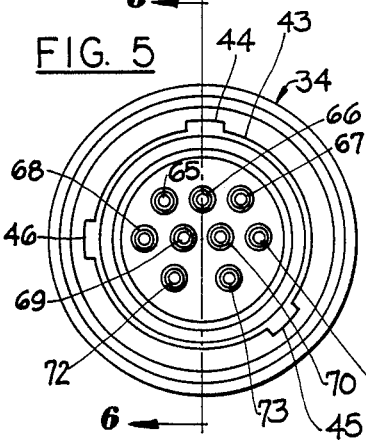
FIG. 5 is a front elevational view of the female plug assembly of FIG. 4, as seen from the left of that figure.
Figure 4:
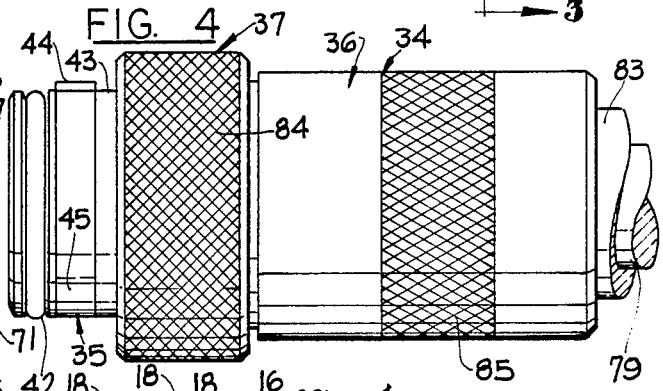
FIG. 4 is an elevational view of the female plug assembly of the present invention.
Figure 6:
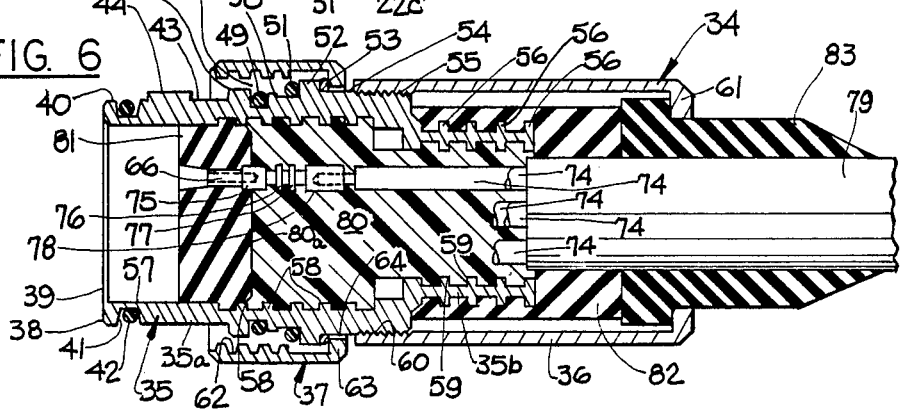
FIG. 6 is a cross sectional view taken along section line 6—6 of FIG. 5.

Reference is now made to FIGS. 4, 5 and 6 illustrating the female plug assembly and wherein like parts have been given like index numerals. The female plug assembly is generally indicated at 34 and comprises a metallic shell 35, a metallic conduit coupler 36 and a rotatable coupler 37. As in the case of the shell 2 of the male receptacle assembly 1, the metallic parts 35, 36 and 37 are preferably made of stainless steel, or brass plated with nickel or chrome.

The shell 35 has a first portion 35*a* and a second portion 35*b* of lesser diameter. The shell 35, at its forwardmost end, has an exterior chamfer 38 and an interior chamfer 39. The forwardmost exterior surface 40 of the shell portion 35*a* is followed by an annular groove 41 containing an O-ring 42. The groove 41 is followed by an exterior surface 43 of just slightly greater diameter than the exterior surface 40. The surface 43 carries three keys 44, 45 and 46, adapted to cooperate with keyways 13, 14 and 15, respectively of the male receptacle assembly 1. The keys 44 through 46 are best shown in FIG. 5. The exterior surface 43 is followed by a raised annular flange 47 which, in turn, is followed by a groove 48 containing an O-ring 49. The groove 48 is followed by a surface 50 supporting an O-ring 51. The O-ring 51 abuts a raised annular flange 52. A resilient washer 53 abuts the opposite side of flange 52. The forward portion 35*a* of shell 35 terminates in an exterior surface 54, the rearwardmost part of which is threaded as at 55. The exterior surface of the rearward portion 35*b* of shell 35 is provided with a plurality of annular ribs 56.

The interior surface of the forward portion 35*a* of shell 35 is provided with a surface 57 of constant diameter. The surface 57, in the rearward half of shell portion 35*a* is provided with a plurality of annular grooves, defining annular ribs 58. Finally, the interior surface of the rearward portion 35*b* of shell 35 is provided with a plurality of inwardly extending annular ribs 59.

The conduit coupler 36 comprises a cylindrical member, the forward end of which is threaded as at 60 and is threadedly engaged on the threads 55 of shell 35. The rearward end of the conduit coupler is open, but has an inturned annular flange portion 61. The purpose of this flange portion will be apparent hereinafter.

The rotatable coupler 37 comprises a cylindrical member, internally threaded as at 62. The rearward end of the rotatable coupler is provided with an inturned annular flange 63 defining an opening 64. The opening 64 has an internal diameter less than the external diameter of shell flange 52 and less than the outside diameter of conduit coupler 36. As a result, the rotatable coupler 37 is rotatably and captively mounted on shell 35 between the shell lug 52 and the conduit coupler 36.

The shell 35 of the female plug assembly is adapted to surround and contain one or more cable terminations provided with female contacts. Again, for purposes of an exemplary showing only, the female plug assembly is illustrated as having nine female contacts 65 through 73, each connected to the end of a cable, some of which are shown in FIG. 6 at 74. The number of female contacts in the female plug assembly 34 is equal to the number of male contacts in the male receptacle assembly 1. All of the female contacts 65 through 73 are substantially identical. Female contact 66 is illustrated in FIG. 6.

Female contact 66 comprises an elongated element having a female socket 75, a pair of annular ribs 76 and 77, and a rearward socket 78 adapted to receive the end of its respective cable 74, stripped of its insulative coating. In FIG. 6, all of the cables 74 are bundled together in an insulative sheath 79.

As is true of the male receptacle assembly 1, the cables 74 and their contacts 65 through 73 of the female plug assembly 34 are surrounded by insulative material which not only maintains them in their proper position within shell 35, but also insulates them one from the other, and from the shell 35. First and second bodies of insulative material 80 and 81 surround the cables 74 and their contacts 65 through 73 and is contained within shell 35. The insulative material for body 80 should be chosen to provide the best insulative characteristics, the best bond to cable insulation, the best bond to shell 35, and the best heat and radiation resistance. The insulative body 81 should also demonstrate these characteristics together with the best insulative properties and the best face seal properties. An epoxy compound of the type described above serves well for the body 80, and the above mentioned EPDM serves well for the body 81. Preferably, the bodies 80 and 81 constitute an integral, one-piece structure of EPDM. It will be understood that the ribs 59 of the shell and the portions 76, 77 and 78 of the female contact 66 serve the same purposes described with respect to the ribs 18 of male receptacle assembly 1 and the elements 22*a* through 22*d* of male contact 22. The ribs 59 of shell 35 also serve the same purpose as the ribs 58.

Another body of insulative material is shown at 82. This body comprises a back seal and should be selected for best bonding to shell 35 and to cable sheath 79, as well as best physical strength. Both EPDM and chlorosulfonated polyethylene serve well as elastomeric compounds from which to make the insulative body 82. Ribs 56 serve the same purpose as ribs 58 and 59.

To complete the female plug assembly, another body of insulative material 83 is provided, serving as a strain relief element for the structure. While this body can be made of the chlorosulfonated polyethylene or EPDM described above, non-nuclear grade chlorosulfonated polyethylene will suffice for its purposes. The flange 61 of conduit coupler 36 abuts body 83.

Figure 7:
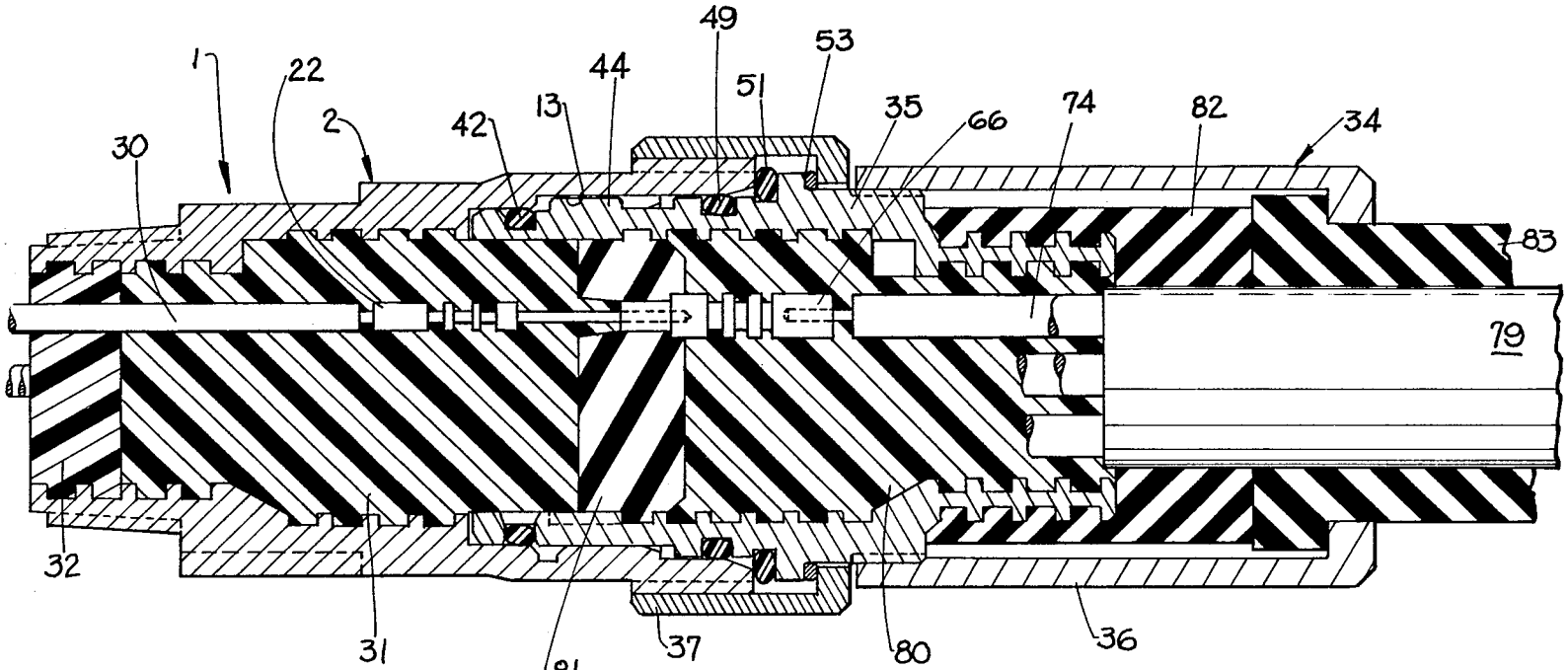
FIG. 7 is a longitudinal cross sectional view illustrating the male receptacle assembly and the female plug assembly in mated and locked condition.
Figure 8:
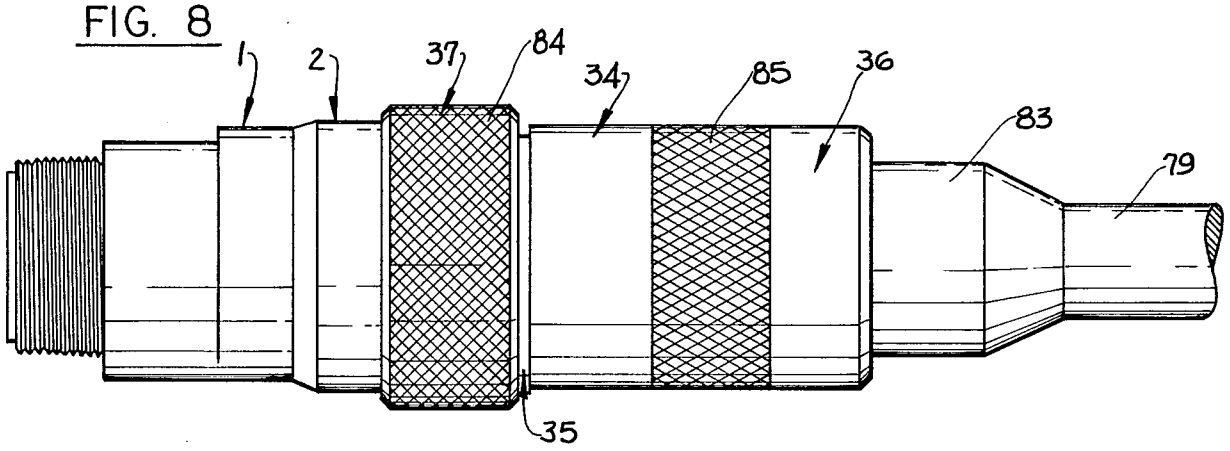
FIG. 8 is an elevational view illustrating the female plug assembly and the male receptacle assembly in mated and locked condition.

The male receptacle assembly 1 and the female plug assembly 3 having been described in detail, the manner in which they mate may now be set forth. Reference is made to FIGS. 7 and 8, wherein like parts have been given like index numerals.

To connect the male receptacle assembly and the female plug assembly, it is only necessary to introduce the forward part of the female plug assembly into the male receptacle assembly. The forwardmost portion of the female plug assembly will enter the male receptacle assembly until the keys 44 through 46 of the female receptacle assembly abut the interior rim 12 of the male receptacle assembly. Further insertion of the female plug assembly into the male receptacle assembly is precluded by this abutment until proper rotational alignment of the assemblies is achieved. This is accomplished by simply rotating the female plug assembly with respect to the male receptacle assembly until the keys 44 through 46 of the female plug assembly align with the keyways 13 through 15, respectively of the male receptacle assembly. This assures that the male contacts 21 through 29 of the male receptacle assembly are properly aligned with the female contacts 65 through 73, respectively of the female plug assembly. At this point the female plug assembly can be shoved further into the male receptacle assembly until the interior threads 62 of the female plug assembly rotatable connector 37 contact the male receptacle assembly exterior threads 4. Rotation of coupler 37 will draw the male receptacle assembly and female plug assembly into fully mated condition. For this purpose, rotatable coupler 37 may have its exterior surface knurled, as shown at 84 in FIG. 4. Similarly, a portion of the exterior surface of the conduit coupler 36 may be knurled, as at 85.

FIGS. 7 and 8 illustrate the male receptacle assembly and the female plug assembly in their fully mated condition. As is most clearly shown in FIG. 7, compression seals are formed by O-rings 42 and 49 between the shell 2 of the male receptacle assembly and the shell 35 of the female plug assembly. In addition, the forwardmost end of male receptacle assembly shell 2 abutts O-ring 51 on the female plug assembly shell, forming a butt seal. An additional seal is formed between the rotatable coupler 37 and the shell 35 of female plug assembly 34 by the resilient washer 53. The contacts of the female plug assembly and the male receptacle assembly are fully mated. The structure of the connector of the present invention minimizes the amount of air trapped between the female plug assembly and the male receptacle assembly. This is important because at temperatures up to about 350° F. air expands and would urge the assemblies away from each other.

To uncouple the female plug assembly from the male receptacle assembly, it is only necessary to rotate the rotatable coupler 37 in the opposite direction. When the interior threads 62 of the rotatable coupler 37 are no longer in engagement with the exterior threads 4 of the male receptacle assembly shell 2, the female plug assembly can simply be pulled away from the male receptacle assembly.

From the above description, it will be apparent that the nuclear connector of the present invention is resistant to heat, steam, moisture and radiation and will maintain its steam-proof and moisture-proof integrity. The structure is fully sealed to prevent leakage through its faces, as well as hosing through the cables. The structure will maintain its integrity even under conditions of a LOCA.

Modifications may be made in the invention without departing from the spirit of it. For example, the connector of the present invention could be applied to in-line use. This would require only simple modification of the male receptacle assembly, providing its cables 30 within appropriate sheath, similar to sheath 79 of the female plug assembly, together with a strain relief element, similar to the element 83 of the female plug assembly.

It would also be well within the skill of the ordinary worker in the art to provide a female receptacle assembly and a male plug assembly.

Finally, when the cable connector of the present invention is to be used in applications wherein it will be subjected to temperatures above about 350° F., silicone and chloronated polyethylene can be used for the insulative materials.

What is claimed is:

1. A cable connector for use in a nuclear environment comprising mateable male receptacle and female plug assemblies, said male receptacle assembly comprising a metallic shell surrounding at least one cable end terminating in a male contact, said female plug assembly comprising a metallic shell surrounding at least one cable end terminating in a female contact, said metallic shells having mateable forward ends and said contacts also having mateable forward ends, the space between each of said metallic shells and its respective cable end and contact being filled by at least one body of heat, steam and radiation resistant insulative material bonded to the inside surface of said shell and the exterior surface of said contact, annular ribs on said inside surface of said shell and annular ribs on said exterior surface of said contact to enhance said bonds and to provide baffles creating pressure drops should said bonds fail, and O-rings mounted on one of said female plug shell and said male receptacle shell to form compression and butt seals therebetween to prevent leakage of steam or moisture through said mateable forward ends thereof.

2. The connector claimed in claim 1 wherein said heat, steam and radiation resistant insulative material is chosen from the class consisting of epoxy compounds; ethylene propylene der-polymer and cholorsulfonated polyethylene.

3. The connector claimed in claim 1 wherein said metallic shells are fabricated from stainless steel.

4. The connector claimed in claim 1 wherein said metallic shells are fabricated from brass plated with a metal chosen from the class consisting of nickel and chrome.

5. The connector claimed in claim 1 including means to maintain said male receptacle shell and said female plug shell in mated condition.

6. The connector claimed in claim 1 wherein said insulative material in said male receptacle shell comprises a single body thereof formed of synthetic rubber chosen from the class consisting of ethylene propylene der-polymer and cholorsulfonated polyethylene.

7. The connector claimed in claim 1 wherein said insulative material in said male receptacle shell comprises a body of epoxy compound having at each of its forward and rearward ends a body of synthetic rubber chosen from the class consisting of ethylene propylene der-polymer and chlorosulfonated polyethylene.

8. The connector claimed in claim 1 wherein said female plug assembly shell has an internally threaded coupler rotatably and captively mounted on the exterior thereof near said forward end thereof, said forward end of said male receptacle shell being externally threaded, said male receptacle threads and said female plug coupler threads being engageable such that rotation of said coupler will draw said male receptacle assembly and said female plug assembly into said mated condition and will maintain them therein, a hollow cylindrical conduit coupler threadedly engaged on said female plug assembly shell and extending rearwardly thereof, said at least one cable end extending therethrough and into said female plug shell.

9. The connector claimed in claim 8 wherein said insulative material in said female plug shell comprises a first body of ethylene propolyene der-polymer, and including a second insulative material body of chlorosulfonated polyethylene surrounding the rearward portion of said female plug shell and said at least one cable end within said conduit coupler and a third insulative material body of chlorosulfonated polyethylene adjacent said second body of insulative material and surrounding said at least one cable end and extending from within said conduit coupler for a short distance rearwardly of said conduit coupler to serve as a strain relief for said at least one cable end.

10. The connector claimed in claim 8 wherein said insulative material in said female plug shell comprises a first body of epoxy compound and a second body of ethylene propylene der-polymer adjacent and forward of said first body and surrounding the forward end of said female contact, a third insulative material body of chlorosulfonated polyethylene surrounding the rearward portion of said female plug shell and said at least one cable end within said conduit coupler and a fourth insulative material body of chlorosulfonated polyethylene adjacent said third body of insulative material and surrounding said at least one cable end and extending from within said conduit coupler for a short distance rearwardly of said conduit coupler to serve as a strain relief for said at least one cable end.

11. The connector claimed in claim 1 wherein each of said male receptacle and said female plug contains a plurality of contacts, said contacts being equal in number and mateable.

12. The connector claimed in claim 11 including at least one key on one of said female plug and male receptacle shells and at least one keyway on the other of said female plug and male receptacle shells assuring proper alignment of said contacts thereof when mated.

13. The connector claimed in claim 12 wherein said female plug assembly shell has an internally threaded coupler rotatably and captively mounted on the exterior thereof near said forward end thereof, said forward end of said male receptacle shell being externally threaded, said male receptacle threads and said female plug coupler threads being engageable such that rotation of said coupler will draw said male receptacle assembly and said female plug assembly into said mated condition and will maintain them therein, a hollow cylindrical conduit coupler threadedly engaged on said female plug assembly shell and extending rearwardly thereof, said at least one cable end extending therethrough and into said female plug shell.

14. The connector claimed in claim 13 wherein said insulative material in said male receptacle shell comprises a single body thereof formed of synthetic rubber chosen from the class consisting of ethylene propylene der-polymer and cholorsulfonated polyethylene.

15. The connector claimed in claim 13 wherein said insulative material in said male receptacle shell comprises a body of epoxy compound having at each of its forward and rearward ends a body of synthetic rubber chosen from the class consisting of ethylene propylene der-polymer and chlorosulfonated polyethylene.

16. The connector claimed in claim 13 wherein said insulative material in said female plug shell comprises a first body of ethylene propylene der-polymer, and including a second insulative material body of chlorosulfonated polyethylene surrounding the rearward portion of said female plug shell and said cable ends within said conduit coupler and a third insulative material body of chlorosulfonated polyethylene adjacent said second body of insulative material and surrounding said cable ends and extending from within said conduit coupler for a short distance rearwardly of said conduit coupler to serve as a strain relief for said cable ends.

17. The connector claimed in claim 13 wherein said insulative material in said female plug shell comprises a first body of epoxy compound and a second body of ethylene propylene der-polymer adjacent and forward of said first body and surrounding the forward ends of said female contacts, a third insulative material body of chlorosulfonated polyethylene surrounding the rearward portion of said female plug shell and said cable ends within said conduit coupler and a fourth insulative material body of chlorosulfonated polyethylene adjacent said third body of insulative material and surrounding said cable ends and extending from within said conduit coupler for a short distance rearwardly of said conduit coupler to serve as a strain relief for said cable ends.

18. The connector claimed in claim 13 wherein said metallic shells are fabricated from stainless steel.

19. The connector claimed in claim 13 wherein said shells are fabricated from brass plated with a metal chosen from the class consisting of nickel and chrome.

* * * * *